US005462454A

United States Patent [19]

Krämer et al.

[11] Patent Number: 5,462,454

[45] Date of Patent: Oct. 31, 1995

[54] SOLDERLESS BOARDLOCK

[75] Inventors: Rudolf Krämer, Lautertal; Manfred Schaarschmidt, Bensheim, both of Germany

[73] Assignee: The Whitaker Corporation, Wilmington, Del.

[21] Appl. No.: 258,647

[22] Filed: Jun. 13, 1994

[30] Foreign Application Priority Data

Jun. 30, 1993 [GB] United Kingdom ..... 9313492

[51] Int. Cl.[6] ..... H01R 13/73

[52] U.S. Cl. ..... 439/571; 439/560; 411/503

[58] Field of Search ..... 439/555, 560, 439/566, 567, 571, 84, 741, 870; 411/501–504, 447–449

[56] References Cited

U.S. PATENT DOCUMENTS

| | | | |
|---|---|---|---|
| 2,329,471 | 9/1943 | King | 411/449 |
| 4,470,649 | 9/1984 | Spencer et al. . | |
| 4,717,219 | 1/1988 | Frantz et al. | 439/82 |
| 4,865,555 | 9/1989 | Assini et al. | 439/82 |
| 4,907,987 | 3/1990 | Douty et al. | 439/571 |
| 5,074,807 | 12/1991 | Parmer | 439/571 |
| 5,108,312 | 4/1992 | Sampson | 439/607 |
| 5,192,228 | 3/1993 | Collins et al. | 439/567 |
| 5,318,465 | 6/1994 | Boyle et al. | 439/741 |
| 5,336,111 | 8/1994 | Thrush et al. | 439/567 |

FOREIGN PATENT DOCUMENTS

| | | | |
|---|---|---|---|
| 1431479 | 4/1976 | United Kingdom | 439/741 |
| 7901050 | 10/1979 | WIPO | 411/448 |

*Primary Examiner*—Gary F. Paumen

*Attorney, Agent, or Firm*—Eric J. Groen; Adrian J. LaRue

[57] ABSTRACT

A boardlock for securely connecting an electrical device or connector to a printed circuit board without requiring post-soldering thereof, is shown comprising a pair of rigid arms joined at the lower end by a thinner bridge section. The boardlock is a flat unitary edge-stamped sheet metal part that is insertable through a hole of a printed circuit board such that the bridge portion extends below the printed circuit board and whereby outer portions thereof, extend outwardly of the hole for provisionally holding the boardlock to the printed circuit board. A die comprising an elongate slot of slightly greater thickness than the boardlock, can be engaged against the bridge portion for permanent plastic deformation thereof. The die has a convex bottomed surface in order to arc the deformed bridge portion towards the printed circuit board in order to enhance the mechanical resistance of the boardlock with respect to an upwards pulling force thereon.

16 Claims, 4 Drawing Sheets

SOLDERLESS BOARDLOCK

BACKGROUND OF THE INVENTION

1. Field of the Invention

This invention relates to a solderless plastically deformable boardlock for permanently securing a connector to a printed circuit board without the need for post-soldering.

2. Summary of the Prior Art

A multitude of different boardlocks are used in the electronics industry for securing an electrical connector or device to a printed circuit board. Some boardlocks are first securely mounted to a connector, and have resilient legs extending therebelow that are engageable in a hole of a printed circuit board for provisionally holding the connector to the printed circuit board. Examples of such boardlocks are disclosed in U.S. Pat. Nos. 5,108,312 and 5,115,375. The boardlocks serve to provisionally hold the connector to the printed circuit board during assembly of other electrical devices. Once the electrical devices are all assembled to the printed circuit board, the board is then taken to a soldering station whereby the electrical connections to the circuit board are permanently soldered thereon, the resilient legs of the boardlock also receiving solder thus being permanently and rigidly secured to the printed circuit board.

Other boardlocks such as in U.S. Pat. No. 4,717,219, do not have resilient legs but instead are inserted through the printed circuit board and then plastically deformed such that they can not be extracted. Post-soldering of these boardlocks is also usually foreseen, because the boardlocks do not hold the device or connector sufficiently securely to the printed circuit board. A further problem with the deformable boardlocks if they don't have resilient legs, is that they can not provisionally hold the connector or device to the printed circuit board during the assembly procedure.

The above boardlocks, although stamped from sheet metal, are relatively complicated and expensive to manufacture.

It is also desirable in the electronics industry to provide a boardlock that doesn't require post-soldering because an increasing number of connectors are being connected to printed circuit boards via compliant pins that require no soldering. The latter is advantageous because it eliminates the need for an extra manufacturing step, namely the soldering process.

SUMMARY OF THE INVENTION

It is therefore an object of this invention to provide a cheap and reliable boardlock for connecting an electrical device to a printed circuit board without requiring post-soldering.

It is a further object of this invention to provide a boardlock with minimal space requirements.

The objects of this invention have been achieved by providing a boardlock that is a unitary edge stamped sheet metal part comprising a U-shaped board mounting section and a connector mounting section, the board mounting section comprising a pair of rigid arms joined at a lower end by a deformable bridge portion whereby the rigid arms and the bridge portion are insertable through a hole in a printed circuit board and the bridge portion is permanently deformable such that the boardlock is held securely to the board.

DETAILED DESCRIPTION OF THE PREFERRED EMBODIMENT

Figure 1:
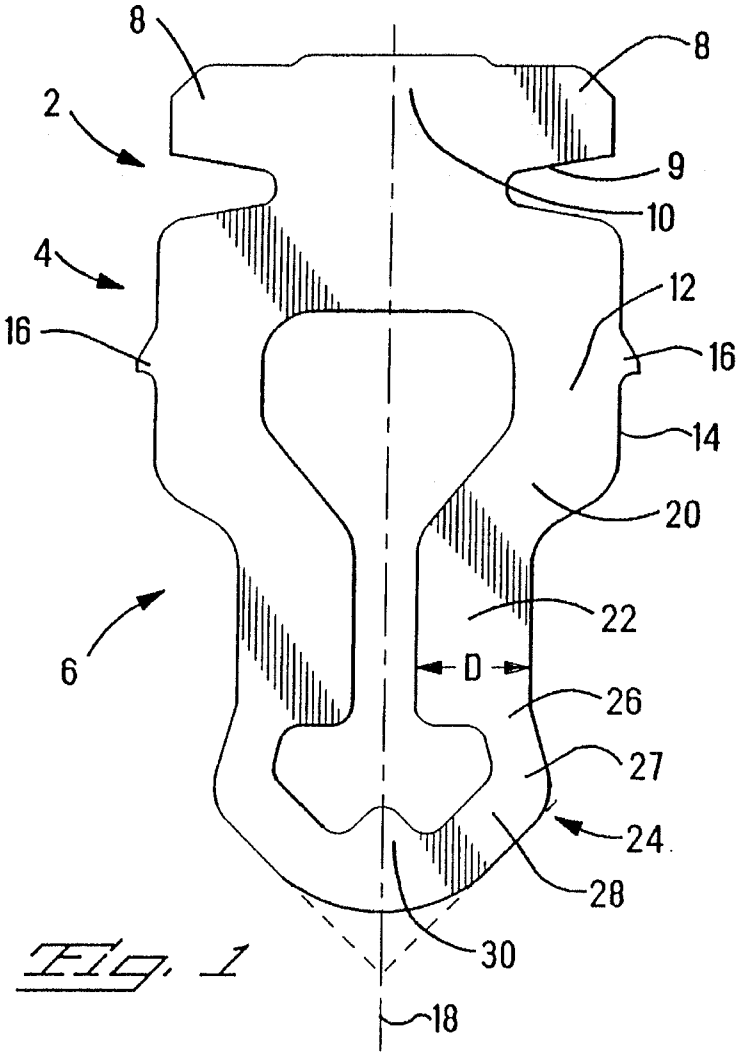
FIG. 1 is a plan view of a boardlock prior to assembly in a connector.

With reference to FIG. 1, a boardlock generally shown at 2 comprises a connector retention section 4 and a printed circuit board connection section 6. The connector section comprises a pair of mirror image deformable mounting tabs 8 attached at an upper end of a central body portion 10, the tabs 8 having a lower inclined edge 9 for engaging a connector housing shoulder. The connector section 4 also comprises a pair of spaced apart guiding legs 12 that have an outer edge 14 and projecting outwards from the outer edge 14 are interference fit retention barbs 16. The connector section 4 and the boardlock section 6 are disposed in mirror image symmetry about a central axis 18. To the guide arms 14 is attached the board connecting section 6 via transitional arm portions 20. The board connecting section 6 comprises rigid spaced apart arms 22 having a thickness D, the rigid arms 22 spaced apart at a lesser distance than the guide arms 14. The board section 6 further comprises a deformable bridge portion generally shown at 24 that extends below the rigid arms and makes connection therebetween. The bridge portion 24 comprises a first bridge portion 26 extending obliquely outwardly and downwardly from the lower portion of the rigid arms 22, and a second bridge portion 28 extending obliquely inwardly and downwardly towards a bridge center portion 30 disposed about the axis 18 of the boardlock. The first and second bridge portions are of a lesser thickness than the thickness D of the rigid arms. The center bridge portion 30 is of greater thickness than the bridge arm section whereby the added thickness projects inwardly of the boardlock.

Figure 2:
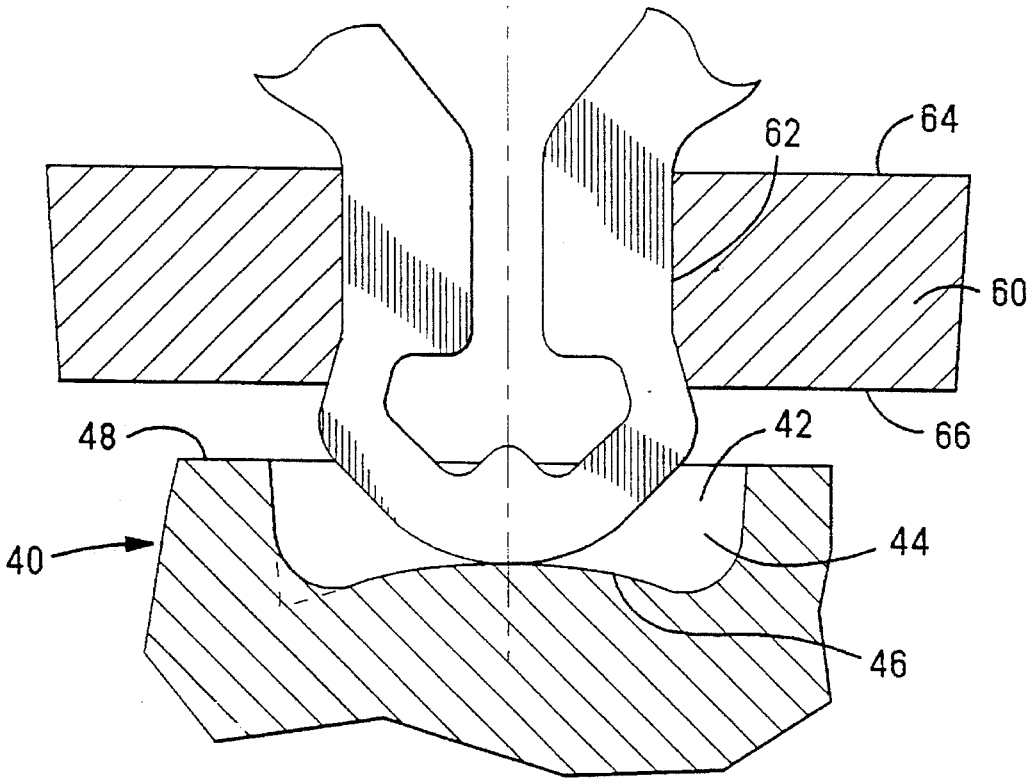
FIG. 2 is a plan view of the boardlock of FIG. 1, inserted through a hole of a printed circuit board and about to be deformed by a die.
Figure 3:
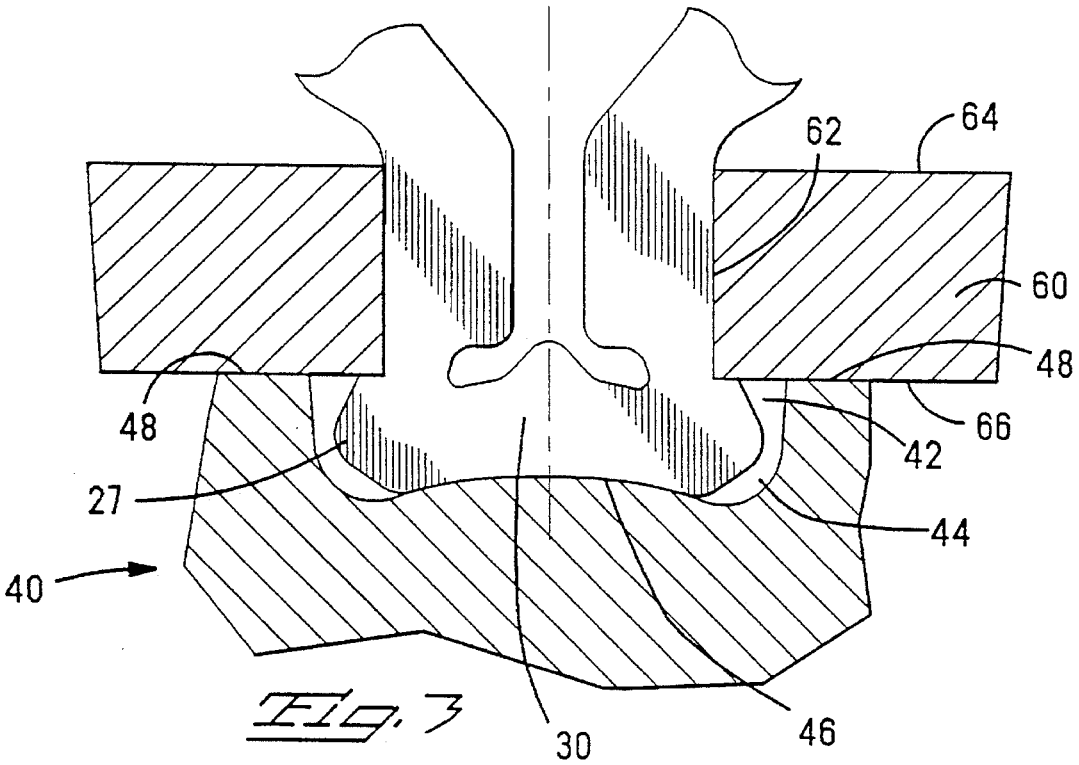
FIG. 3 is the same view as FIG. 2 whereby the boardlock is permanently deformed by the die.
Figure 5:
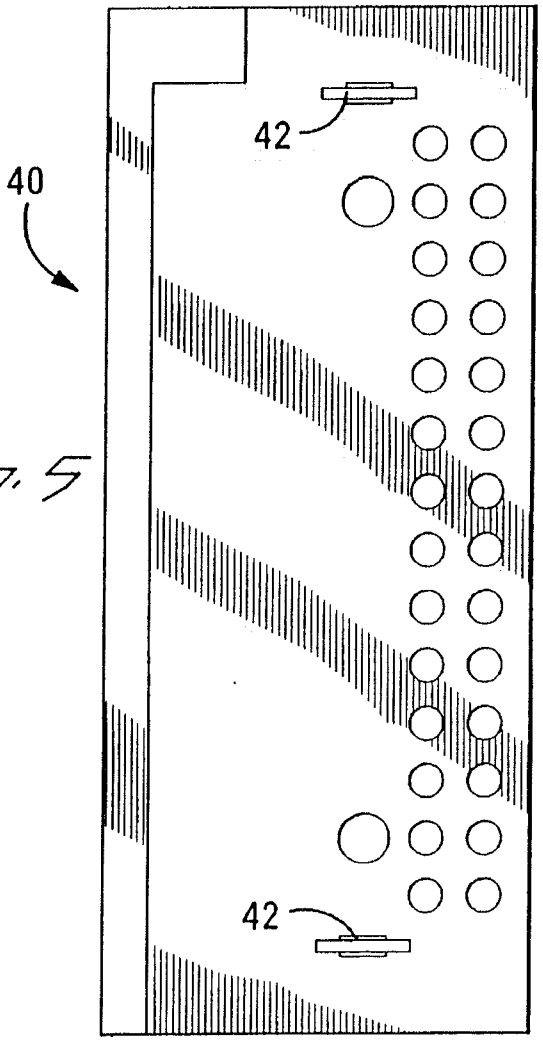
FIG. 5 is a top view of a die.

With reference now to FIGS. 2 and 3, a die 40 partially shown in cross section comprises an elongate boardlock receiving cavity 42 having lateral front and back walls 44, and a convex bottom wall 46.

Figure 4:
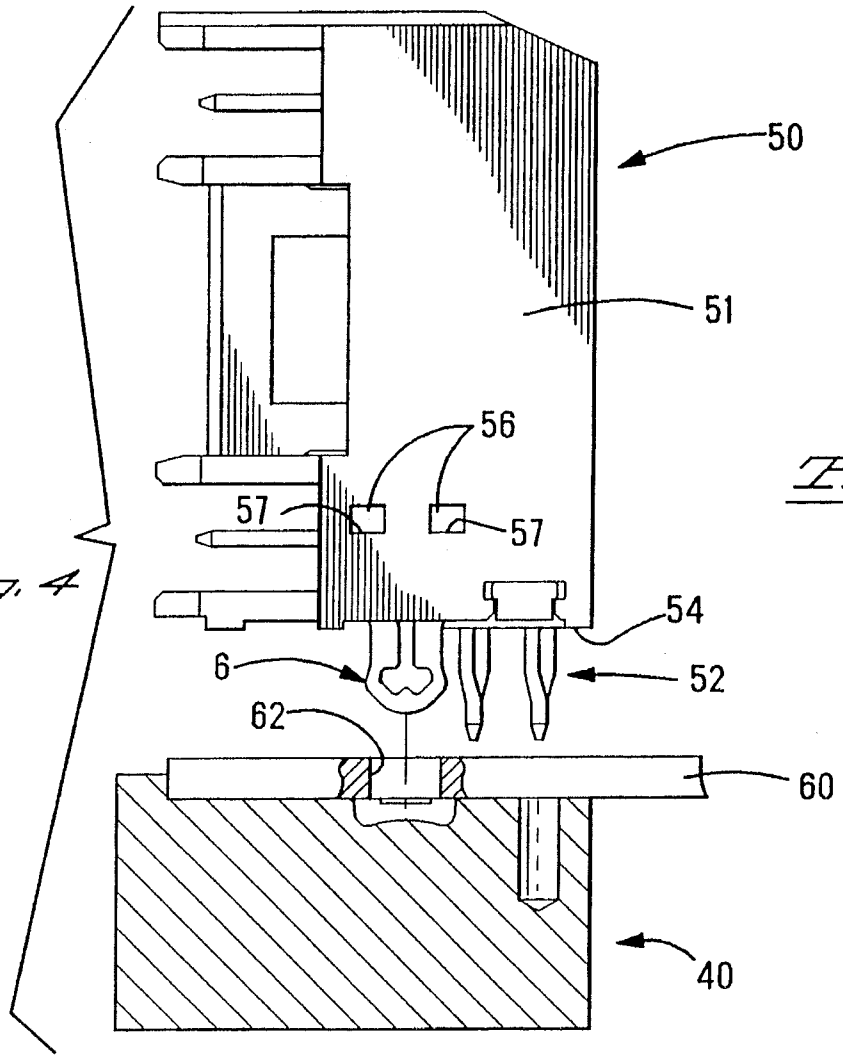
FIG. 4 is a view of a boardlock assembled to a right angled connector about to be mounted to a printed circuit board.

With reference now to FIG. 4, an electrical connector generally shown at 50 comprises a housing 51, a plurality of compliant pins 52 projecting below a printed circuit board mating face 54, and a pair of boardlock retention window cavities 56. Within the window cavities 56 is a shoulder 57 engageable against deformed tabs of a boardlock for retention thereof. The connector 50 also comprises boardlock receiving cavities 58.

Referring back to FIG. 2, 3 and 4, a printed circuit board 60 is shown comprising a cylindrical boardlock receiving hole 62.

Referring to FIG. 2, the boardlock 2 is shown already mounted into the hole 62 of the printed circuit board. The rigid arms 22 are comprised within the hole 62 and are spaced apart such that they press against the outer diameter thereof and because the boardlock is a substantially flat edge stamped sheet metal part, the plane of the rigid arms corresponds roughly to a plane that includes the axis of the hole 62.Extending outwardly of the hole, are the first bridge arm portions 26 and in order to assemble the boardlock to the printed circuit board, the bridge arm first and second portions 26,28 are elastically deformable towards the axis 18 such that the boardlock can be inserted from the upper side 64 of the board 60 through the hole 62. Once the boardlock is fully inserted into the hole 62, the first bridge portion thus bulges outwards of the hole 62 thereby provisionally and elastically securing the boardlock thereto. FIG. 2 shows the die 40 on the point of engaging the boardlock. The side walls 44 of the die are spaced apart at a distance only slightly greater than the thickness of the boardlock such that they act as a guide and prevent the boardlock from bending out of its planarity. The boardlock is a thin sheet metal part, and unless it is guided such that it stays flat, any deformation force will tend to bend the bridge portion of the boardlock out of its plane; and particularly so because the hole 62 is circular and provides no lateral support of the boardlock.

Now referring to FIG. 3, an upper surface 48 of the die is shown pressed against a lower surface 66 of the printed circuit board 60, the bridge portion 24 of the boardlock consequently being plastically deformed such that the first bridge portion partially deforms around the corner of the edge of the hole 62; and the outer portions 27 bulge even further outwards of the hole 62 than in the undeformed position. The boardlock is thus held securely and permanently to the board 60 and cannot be extracted by an upwards pulling force. Outwards deformation of the bridge outer portions 27 is ensured because the first 26 and second 28 bridge portions which are of lesser width than the rigid arms 22, are obliquely and outwardly slanted towards the outer portions 27. The convex shape of the die bottom wall and hence that of the deformed boardlock center portion 30, has a particular purpose as will become apparent below.

The arcuately deformed bridge portion of the boardlock serves to enhance the strength with which the boardlock is retained to the printed circuit board. A large extraction force applied to the boardlock will be taken up by the deformed outer portions 27 that press against the lower surface 66 of the printed circuit board at the outer edge of the hole 62, whereby this force will cause a moment that will tend to pivot the center portion 30 upwards towards the connector. If this force is large enough to cause plastic deformation, the bridge portion will further buckle, but this buckling will be inhibited by the bridge portion 24 abutting the lower end of the rigid arms 22. If the forces on the boardlock are such, however, that the center portion 30 attempts to pivot downwardly away from the connector 50, then this will tend to force the bulge portions 27 even more further outwards as the arcuate shape will tend to straighten out and thus increase the distance between the bulge portions 27. If the center portion 30 of the boardlock was deformed flatly or having a curvature directed away from the board 60 e.g. as with the undeformed boardlock, then a pulling force on the boardlock would tend to pivot the center portion 30 away from the board 60 thus causing the outer portions 27 to collapse inwards, the boardlock thus being pulled through the hole 62.

Although the boardlock is flat and comprises relatively little material, especially in comparison to cylindrical shaped boardlocks, it is very strong because all of the forces are comprised within the plane of the sheet metal. This makes far more efficient use of the material strength than, for example, tabs bent transversely to the plane of the sheet metal.

The added thickness of the center portion 30 with respect to the first and second bridge portions 26, 28 serves to ensure correct inward arcuate deformation of the bridge portion and in particular to prevent buckling of the center portion 30 under the compressive forces that the second bridge portions 28 are subject to during the deformation process.

Figure 6:
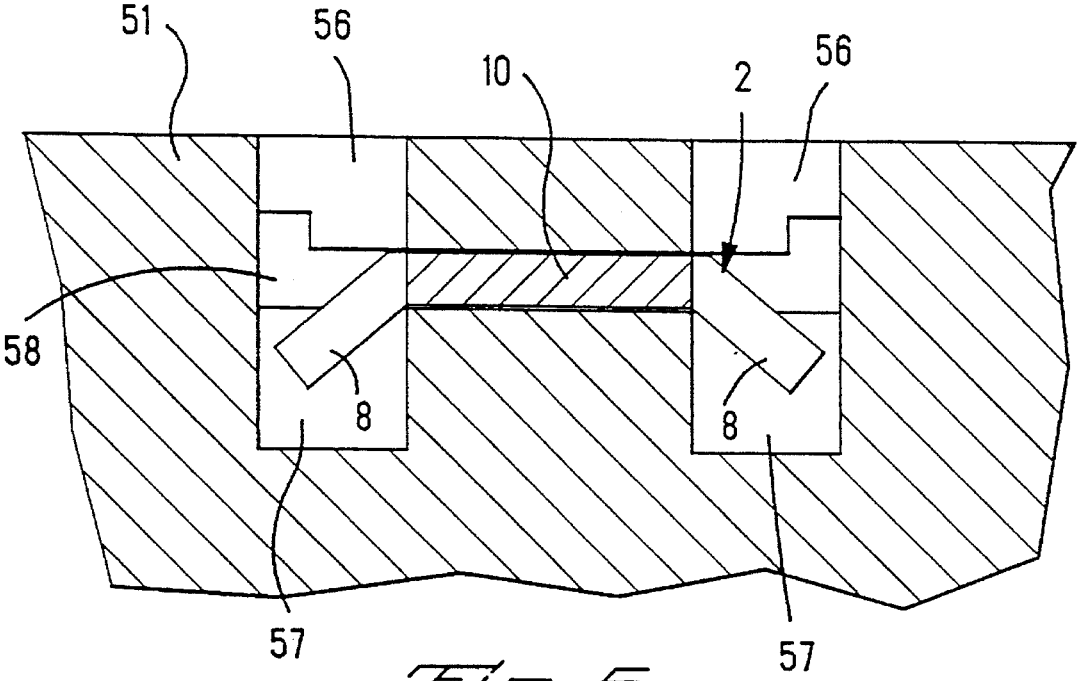
FIG. 6 is a cross sectional view through a boardlock mounted in a connector housing.
Figure 8:
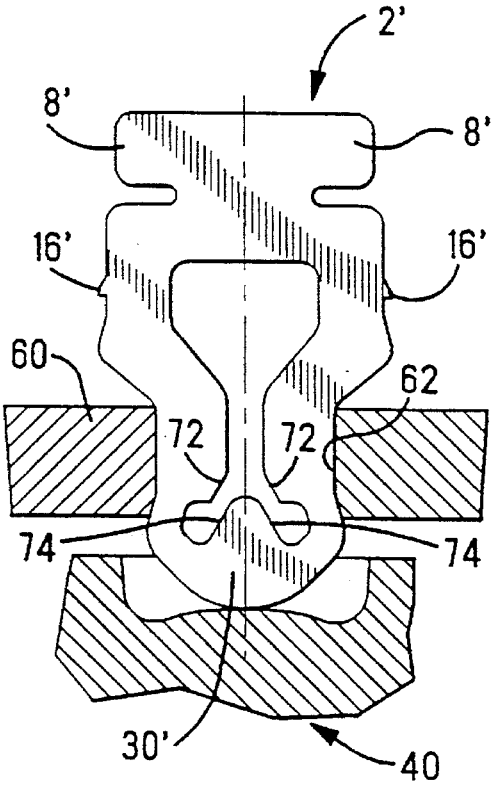
FIG. 8 is the boardlock of FIG. 7 inserted through a circuit board hole and about to be deformed by a die.

Elongate cavities 58 (see FIG. 6) are provided in the connector housing for receiving the boardlock connector section 4, whereby the outer edges 14 of the guide arms 12 engage in an interference fit with the cavities 58, the retention barbs 16 preventing extraction of the boardlock therefrom. In order to further secure the boardlock to the housing, the deformable tab members 8 can be transversely bent (around axes substantially parallel to the axis of the board hole 62) into corresponding cavities of the connector whereby this bending is achieved once the boardlock is fully inserted into the cavity 58 by a special tool (stamping die) that is inserted through the windows 56 of the connector which are adjacent the deformable members 8 (see FIGS. 4 and 6). The inclined lower edge 9 of the tab 8 ensures that pivotable deformation thereof progressively engages and tightens the tab edge 9 against the shoulder 57 which eliminates play and securely retains the tab 8 against the shoulder 57.

As seen in FIG. 4, the right angled connector 50 is for making electrical connection to a printed circuit board via the compliant pins 52. The compliant pins 52 have a pair of reversed C-shaped resilient arms that are resiliently biasable against electrical circuit traces that line corresponding holes of the printed circuit board thus making electrical contact therewith. This type of contact does not therefore require soldering, hence the need for a boardlock that correspondingly does not require soldering but nevertheless provides the reliability and strength of soldered boardlocks.

Figure 7:
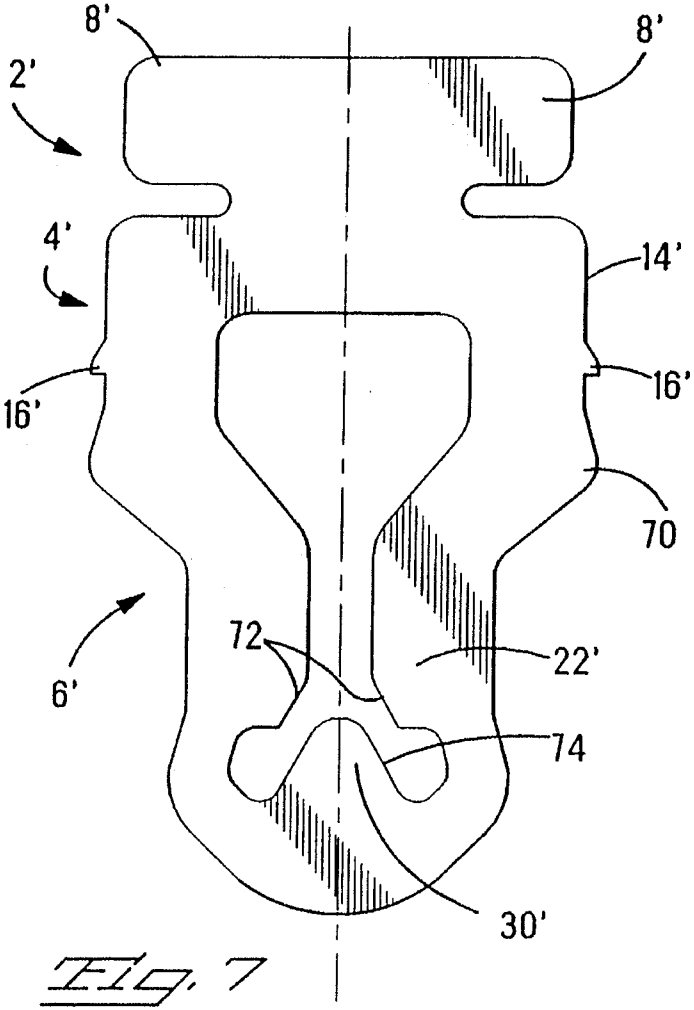
FIG. 7 is a plan view of another embodiment of a boardlock.
Figure 9:
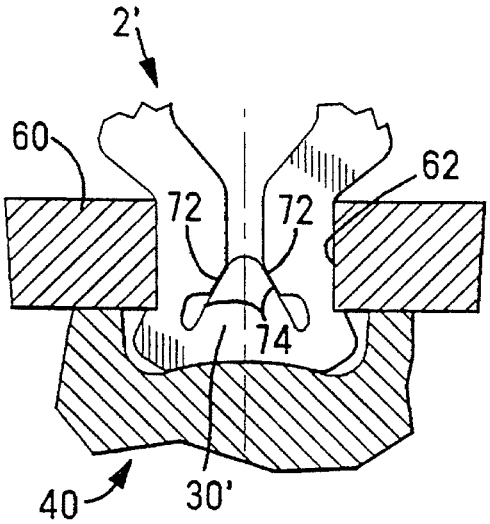
FIG. 9 is a similar view to FIG. 8 but with the boardlock permanently deformed by the die.

Referring to FIG. 7, another embodiment of the boardlock is shown, similar to the boardlock of FIG. 1 whereby the similar features are denoted by the same numbers with a prime. The main differences between the embodiment of FIG. 7 and that of FIG. 1, are the outwardly protruding bulges 70 along side the outer edge 14', the more pronounced lower central portion 30' and the tapered inner edges 72 adjacent the lower end of the ridged arms 22', the center portion 30' having an outer tapered profile 74 engageable against the tapered edges 72. The purpose of the bulges 70 on the outer edge 14', is to fit interferingly in a cavity 58 of a connector housing such that the boardlock 2' sits firmly therein without play. The purpose of the tapered edges 72, is to provide a surface against which the protruding central portion 30' abuts once the boardlock 2' has been deformed by the die as shown in FIG. 9, whereby the tapered edges 74 of the central portion 30' abut against the tapered edges 72. The latter feature enhances the extraction force required to pull out the boardlock from the printed circuit board hole by wedging the central portion 30' between the ridged arms 22' hence preventing the arms 22' from collapsing together.

Advantageously therefore, due to the flat, simple construction of this boardlock, it is inexpensive and yet provides a strong mechanical connection without requiring an additional soldering step and is therefore ideally adapted to connectors that are assembled to the printed circuit board without soldering. The mechanical strength is further enhanced by the inwardly arcuate curvature of the deformed bridge portion. Additional advantages, are the simple assembly of the boardlock to a connector due to the deformable tabs, and the reduced space requirements, namely the flatness of the boardlock requires little extra length of the connector as opposed to for example, a cylindrical boardlock. This invention is also compatible with a soldering process whereby the advantages of cost, space, simplicity and reliability are still valid.

We claim:

1. A boardlock for mechanically fixing a connector to a printed circuit board wherein the boardlock is a unitary edge-stamped sheet metal part comprising a U-shaped board mounting section, and a connector mounting section, the board mounting section comprising a pair of rigid arms joined at a lower end by a deformable bridge portion whereby the rigid arms and bridge portion are insertable through a hole in the printed circuit board and the bridge portion is permanently deformable such that the boardlock is held securely to the board without requiring post-soldering, the bridge portion being deformable into a substantially concave arcuate shape whereby a center portion of the bridge portion is disposed roughly at a centerline of the board hole and is at a lesser distance to the printed circuit board than extremities of the arc when deformed, and wherein the bridge portion comprises a pair of deformable arms of less width than the rigid arms, and a center portion joining the arms whereby the center portion is of greater width than the deformable arms and whereby the added thickness of the center portion is directed towards the board to allow the concave arcuate deformation of the bridge portion to occur.

2. The boardlock of claim 1 characterized in that the center portion has obliquely slanted edges wedgeable between tapered edges at lower ends of the rigid arms when the boardlock is deformably assembled to the board.

3. A boardlock for mechanically fixing a connector to a printed circuit board characterized in that the boardlock is a unitary edge-stamped sheet metal part comprising a U-shaped board mounting section, and a connector mounting section, the board mounting section comprising a pair of rigid arms joined at a lower end by a deformable bridge portion whereby the rigid arms and bridge portion are insertable through a hole in the printed circuit board and the bridge portion is permanently deformable such that the boardlock is held securely to the board without requiring post-soldering, the bridge portion comprising a pair of deformable arms and a center portion joining the deformable arms whereby the center portion is of greater width than the deformable arms and whereby the added width of the center portion is directed towards the board to allow the concave arcuate deformation of the bridge portion to occur, the center portion further having obliquely slanted edges wedgeable between tapered edges at lower ends of the rigid arms when the boardlock is deformably assembled to the board.

4. The boardlock of claim 1 or 3 characterized in that the board mounting section is substantially planar and symmetrical.

5. The boardlock of claim 4 characterized in that the connector mounting section is substantially planar to the board mounting section just prior to assembly to the connector.

6. The boardlock of claim 1 or 3 characterized in that the bridge portion has a pair of bridge arms having a first portion attached respectively to the rigid arms, the first portion extending obliquely outwards and downwardly therefrom, and a second portion departing respectively from the first portions obliquely inwards and downwardly therefrom to join a center portion, whereby a pair of portions formed by the intersection of the first and second portions protrude outwardly beyond the hole diameter.

7. The boardlock of claim 1 or 3 characterized in that the connector mounting section comprises a pair of deformable tabs that engage in corresponding cavities of the connector for securely fixing the boardlock thereto.

8. The boardlock of claim 7 characterized in that the connector mounting section comprises tabs deformable about axes substantially parallel to the axis of the board hole.

9. The boardlock of claim 8 characterized in that the connector mounting section comprises tabs deformable through windows of a connector by a stamping die.

10. The connector of claim 9 characterized in that the deformable tabs comprise a lower edge engageable against a shoulder of a connector housing, whereby the edge is inclined with respect to the surface of the shoulder such that the exterior portion of the tab edge is farther from the shoulder surface than the inner portion of the tab edge.

11. A boardlock for fixing a connector to a circuit board comprising:

a connector mounting section; and a U-shaped board mounting section, which is insertable in a hole in a circuit board, including a pair of rigid arms extending downwardly from said connector mounting section and joined together by a deformable bridge portion, said deformable bridge portion including a center portion and a pair of bridge arms extending from said rigid arms attached to said center portion which deform outwardly engaging the circuit board when said center portion is upwardly deformed towards the connector mounting section thereby securing said boardlock to the circuit board without requiring post-soldering, wherein said center portion has obliquely slanted edges wedgeable against tapered edges at lower ends of the rigid arms when the center portion is upwardly deformed.

12. The boardlock of claim 11, wherein said bridge arms have a first portion attached respectively to said rigid arms, said first portion extending obliquely outwardly and downwardly therefrom, and a second portion extending respectively from said first portion obliquely inwardly and downwardly therefrom to join said center portion, whereby the intersection of the first and second portions protrude outwardly beyond the hole.

13. The boardlock of claim 11, wherein said center portion is deformed in an arcuate shape.

14. The boardlock of claim 11, wherein said connector mounting section comprises a pair of deformable tabs that engage in corresponding cavities of a connector for securely fixing the boardlock thereto.

15. The boardlock of claim 14, wherein said deformable tabs are adapted to be deformed through slots in the connector by a tool.

16. The boardlock of claim 14, wherein said deformable tabs have a lower edge engageable against a shoulder surface of a connector housing, whereby said lower edge is inclined with respect to said shoulder surface such that an exterior edge portion of said lower edge is farther from said shoulder surface than an inner edge portion of said lower edge.

* * * * *